United States Patent [19]

Lewchuk

[11] 4,118,911

[45] Oct. 10, 1978

[54] GLAZING TOOL

[75] Inventor: Richard R. Lewchuk, Pittsburgh, Pa.

[73] Assignee: PPG Industries, Inc., Pittsburgh, Pa.

[21] Appl. No.: 771,597

[22] Filed: Feb. 24, 1977

[51] Int. Cl.[2] ..... B30B 1/12; E04F 21/00

[52] U.S. Cl. ..... 52/749; 52/203; 52/DIG. 1; 81/3 R; 156/71; 156/109

[58] Field of Search ..... 52/202, 203, 204, 173, 52/749, DIG. 1, 746, 172; 81/3 R; 29/238, 267; 269/321 S, 81; 156/598, 580, 71, 109

[56] References Cited

U.S. PATENT DOCUMENTS

| | | | |
|---|---|---|---|
| 810,604 | 1/1906 | Baier | 52/204 |
| 2,365,787 | 12/1944 | Wallace | 29/238 |
| 2,607,088 | 8/1952 | Schoepfer | 52/202 |
| 2,794,217 | 6/1957 | Craft | 52/204 |
| 3,971,178 | 7/1976 | Mazzoni et al. | 52/172 |

*Primary Examiner*—William A. Powell
*Assistant Examiner*—Michael W. Ball
*Attorney, Agent, or Firm*—Donald Carl Lepiane

[57] ABSTRACT

A tool for installing a pane to an existing glazing to provide an insulating, sealed airspace therebetween includes a plate having a pin on one surface to secure the tool to a frame of the existing glazing. A shaft slidably mounted on the other side of the plate urges a blade against the marginal edges of the pane to flow adhesive between the pane and existing glazing to form a hermetic seal.

3 Claims, 5 Drawing Figures

FIG. 1
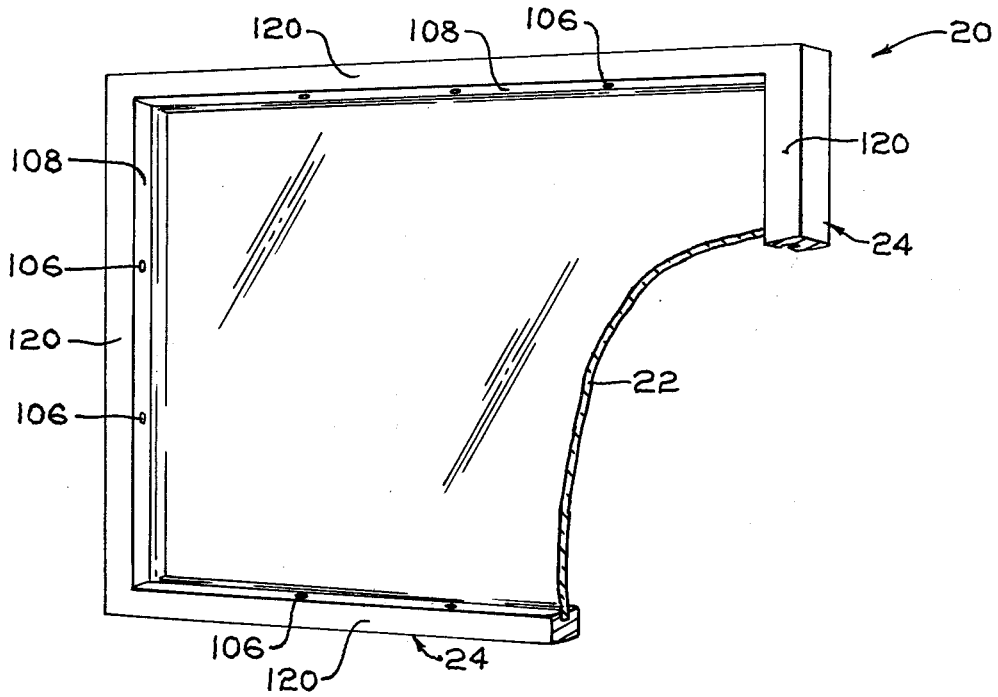
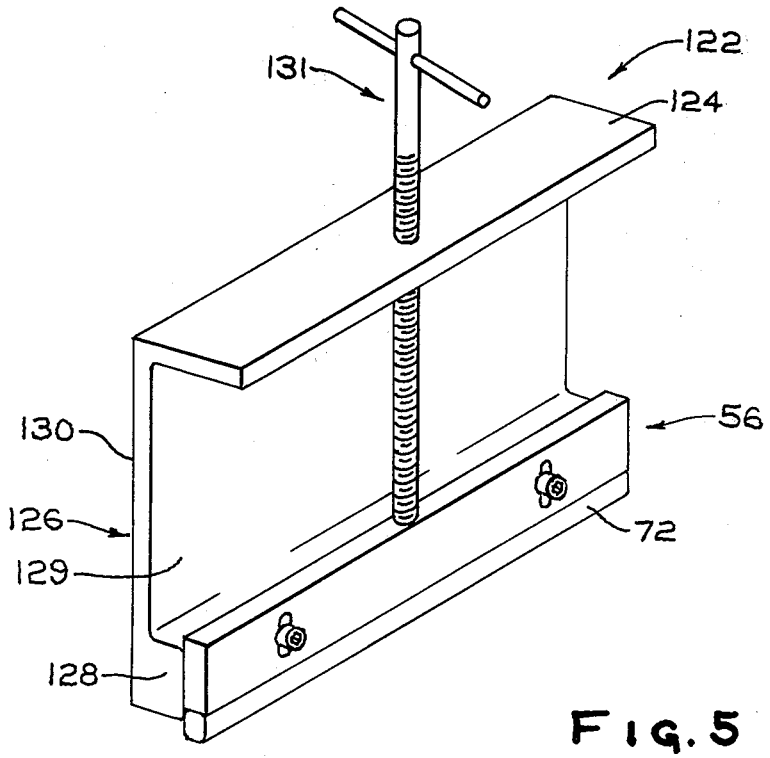
FIG. 5

GLAZING TOOL

BACKGROUND OF THE INVENTION

1. Field of the Invention

This invention relates to a tool for installing a pane to an existing glazing to provide an insulating, sealed airspace therebetween.

2. Discussion of the Technical Problem

U.S. Pat. No. 3,971,178 teaches a method of adding a pane to an existing glazing installation to provide an insulating, sealed airspace therebetween.

In general, the pane includes a spacer frame mounted on marginal edges of the pane by a moisture-impervious sealant. A moisture-impervious adhesive between the spacer frame and the existing glazing is flowed under pressure to form the insulated, sealed airspace between the pane and the existing glazing.

U.S. Pat. No. 3,971,178 in column 7, lines 54–61 teaches that pressure for flowing the adhesive may be applied by clamping facilities carried by glass holding equipment; by special leverage facilities coacting with the frame or wall structure; or to impose a vacuum in the newly created airspace for sufficient time to permit the moisture-impervious adhesive to flow and seal. Both the vacuum and mechanical facilities may be used simultaneously.

Although not specifically described, leverage facilities that have been used include a spreader bar having its ends mounted between opposing wall structure containing the glazing. A blade operatively connected to the spreader bar by way of a threaded shaft is positioned on the marginal edges of the pane. Rotating the threaded shaft urges the blade against the marginal edges of the pane of flow the adhesive between the spacer frame and glazing.

Although the above technique is acceptable, there are limitations. For example, applying a downward pressure on the blade to flow the adhesive applies an opposite force acting to move the spreader bar away from the pane. If the spreader bar is not secured in position, the spreader bar will move from between the wall structure. If too much pressure is applied by the spreader bar to the wall structure, the wall structure may be damaged.

It would be advantageous therefore to provide a tool for installing panes to existing glazing that does not have the limitations of the prior art spreader bar and blade assembly.

SUMMARY OF THE INVENTION

This invention relates to a tool for installing a pane to an existing glazing. A plate member has a pin mounted thereon for mounting the plate member to a frame of the existing glazing. Facilities are mounted on the plate member for biasing the add-on pane toward the existing glazing.

This invention also relates to a method of installing an add-on pane having a layer of adhesive to a sheet of a glazing structure. A tool is provided having a pin and biasing facilities mounted on a plate member. A hole is drilled in the frame for receiving the pin and the add-on pane is mounted to the sheet. Thereafter the pin of the tool is inserted in the hole and the biasing facilities urge the pane toward the sheet to flow the adhesive.

BRIEF DESCRIPTION OF THE DRAWING

FIG. 1 is a perspective view, partially cut away, of a single glazing window installation upon which the present invention may be practiced;

FIG. 5 is an isometric view of an alternate embodiment of the tool incorporating the features of the invention.

DESCRIPTION OF THE INVENTION

With reference to FIG. 1, there is shown a single glazing window installation or window unit 20 that would typically form a part of a building wall structure. The window unit 20 includes a glass sheet 22 mounted in a frame 24 in any conventional manner. Although not shown, the frame 24 is mounted in a wall structure in any conventional manner.

Figure 2:
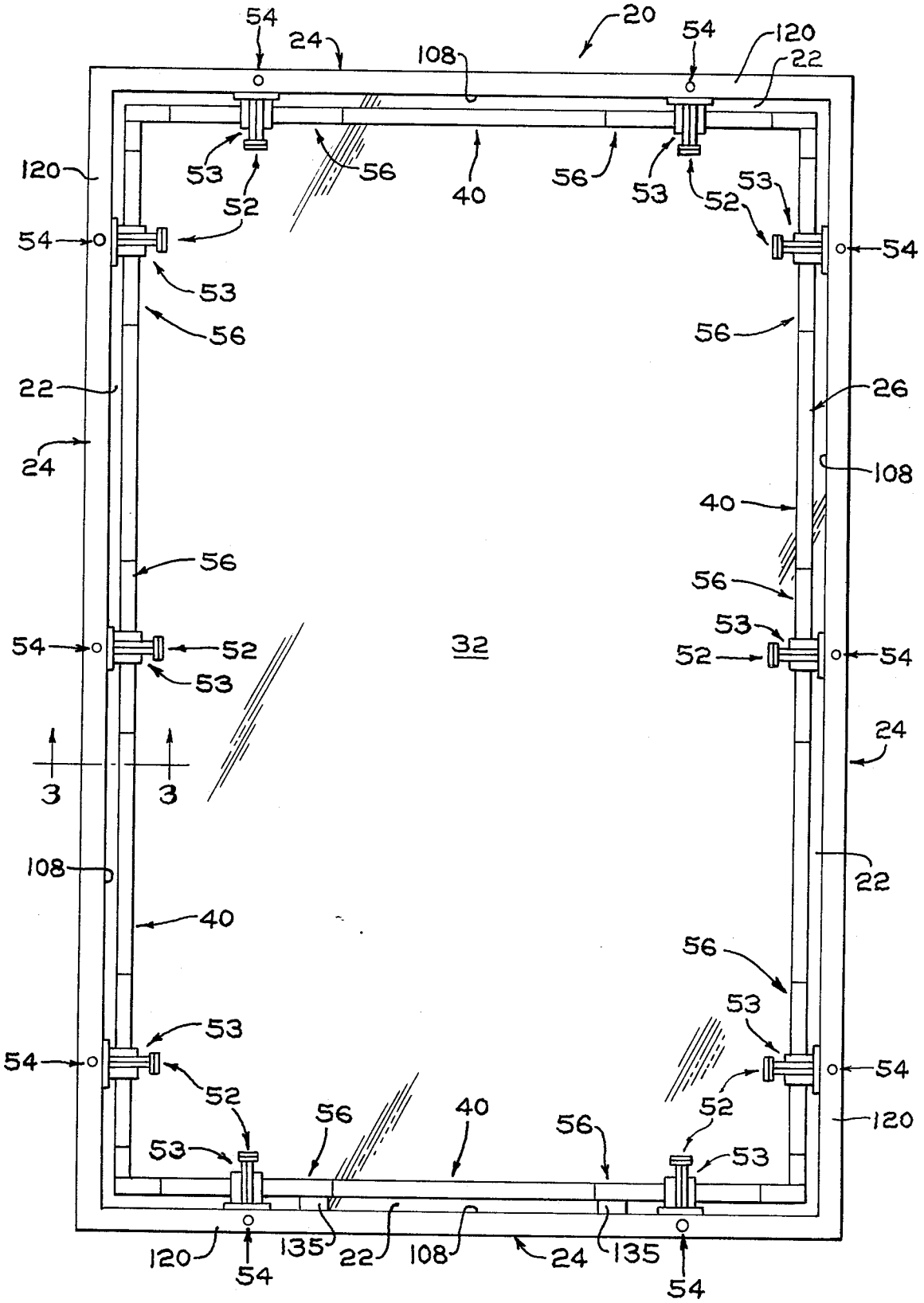
FIG. 2 is a frontal view of the glazing window of FIG. 1 having tools incorporating features of the invention mounted thereon to urge a pane against the glazing window.
Figure 3:
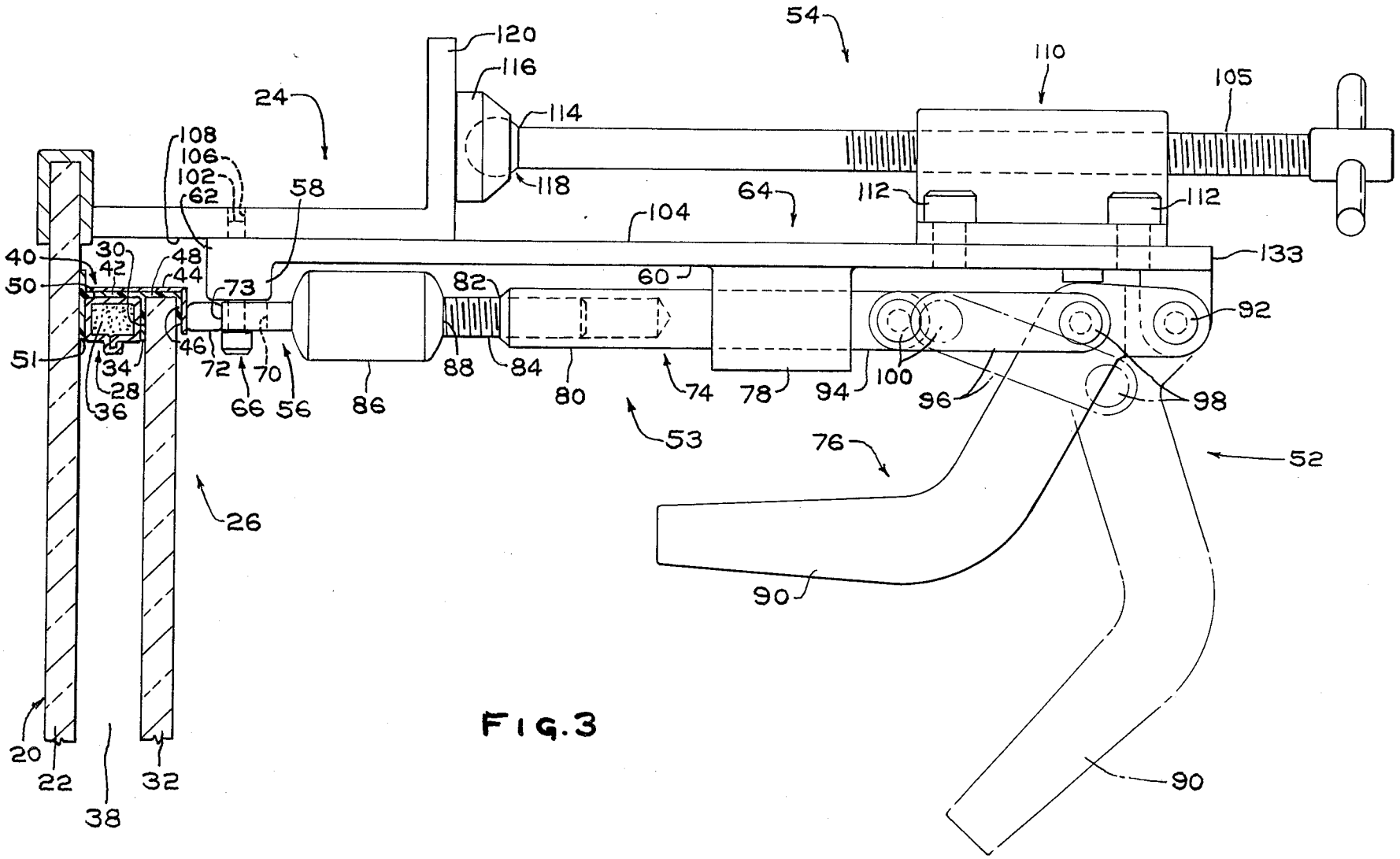
FIG. 3 is a view taken along lines 3—3 of FIG. 2.

Referring now to FIGS. 2 and 3, there is shown a pane 26 that may be used in the practice of the invention. With specific reference to FIG. 3, the pane 26 includes a spacer frame 28 mounted to inner marginal edges 30 of a glass sheet 32 by an adhesive 34. Although not limiting to the invention, the adhesive 34 is preferably a moisture-resistant sealant of the types used in the multiple glazing art.

The expressions "moisture-resistant", "barrier against moisture penetration", and "hermetic seal", as used herein, refer to an ability to prevent passage of water vapor to such an extent that the subject material or structure is capable of being utilized in a multiple glazed architectural installation. To qualify for such architectural use, a material or structure should present enough of an obstacle to water vapor transmission to preclude condensation of water vapor in the interior of a multiple glazed unit at temperatures down to about 0° F. (i.e., about $1.77 \times 10^{-5}$ grams of water per cubic inch of air in the unit) and preferably lower, over a period of several years. The time period required is at least about 3 to about 5 years, but preferably is at least about 10 years, and in optimum cases is at least about 20 years.

The amount of water vapor penetration depends not only on the inherent moisture vapor transmission of the material employed as the obstacle, but also on the dimensions (e.g., thickness) of the obstacle in the path of water vapor penetration. Because visual aesthetics must be considered in regard to architectural glazing, it is desirable to minimize the dimensions of the water vapor barriers, thus materials having a relatively low moisture vapor transmission are preferred. For this reason, it is generally preferred that the materials used for moisture barriers in multiple glazing have a moisture vapor transmission of less than about 15 grams (preferably less than about 6 grams) per 24 hours per square meter per mil thickness at 100° F. and 90 percent relative humidity as determined by A.S.T.M. E-96-66E. Desiccants are often included in multiple glazed units to adsorb moisture vapor in the airspace, and when a desiccant is employed, the requirements for moisture barriers may be relaxed by an amount corresponding to the water adsorbing capacity of the desiccant.

With specific reference to FIG. 3, the spacer frame 28 preferably has a desiccant material 36 therein and communicates with airspace 38 between the glass sheet 32 of the pane 26 and glass sheet 22 of the glazing 20 in any conventional manner.

A composite strip 40 including a moisture-resistant sealant or adhesive 42 mounted on a bendable flexible tape 44 is mounted on outer marginal edges 46 and peripheral edge 48 of the glass sheet 32 of the pane 26 and outer peripheral edges 50 of the spacer frame 28.

The pane 26 as shown in FIG. 3 is similar to that shown in FIG. 15 of U.S. Pat. No. 3,971,178 and in FIG. 8 in U.S. Pat. No. 3,928,953. For further discussions of the pane 26 that may be used in the practice of the invention, reference may be made to the teachings of U.S. Pat. Nos. 3,971,178 and 3,928,953 which teachings are hereby incorporated by reference.

As will become apparent, the invention is not limited to the construction of the pane 26 and any of the constructions taught in U.S. Pat. Nos. 3,971,178 and 3,928,953 as well as the type taught in U.S. Patent Application Ser. No. 594,907 filed July 10, 1975 in the name of John P. Bologna for "Glazing Unit and Method for Reducing Transmittance of Solar Radiation" may be used in the practice of the invention. The teachings of the above-identified U.S. Patent Application are hereby incorporated by reference.

The pane 26 is mounted on the sheet 22 of the glazing installation 20 by flowing an adhesive 51 between the spacer frame 28 and sheet 22 of the glazing installation 20.

Preferably the composition and width of adhesive 51 are selected so as to form a moisture-resistant barrier when bonded to the glass sheet 22 in a manner to be discussed below. The adhesive 51 may be a polysulfide or silicon but is preferably a room temperature curable or vulcanizable material that will cold flow to form a moisture-resistant seal and a resilient structural bond. Butyl-based mastics are preferred, such as the two component, room temperature curable, butyl-based mastic disclosed in U.S. Pat. No. 3,791,910 to George H. Bowser. The teachings of U.S. Pat. No. 3,791,910 are hereby incorporated by reference.

On-site assembly is substantially expedited by providing a tacky, non-curing composition for the adhesive 51. A non-curing moisture-resistant adhesive that may be used in the practice of the invention has the following composition:

| Component | (Weight %) |
|---|---|
| polyisobutylene (viscosity average molecular weight 75,000 - 100,000) | 15–50 |
| polyisobutylene (viscosity average molecular weight 8,000 - 10,000) | 10–45 |
| carbon black | 10–45 |
| silica pigment | 5–15 |
| zirconium orthosilicate | 5–15 |
| polybutene | 20–50 |
| zinc oxide | 0–5 |
| gamma-glycidoxy-propyltrimethoxysilane | 0–5 |

Figure 4:
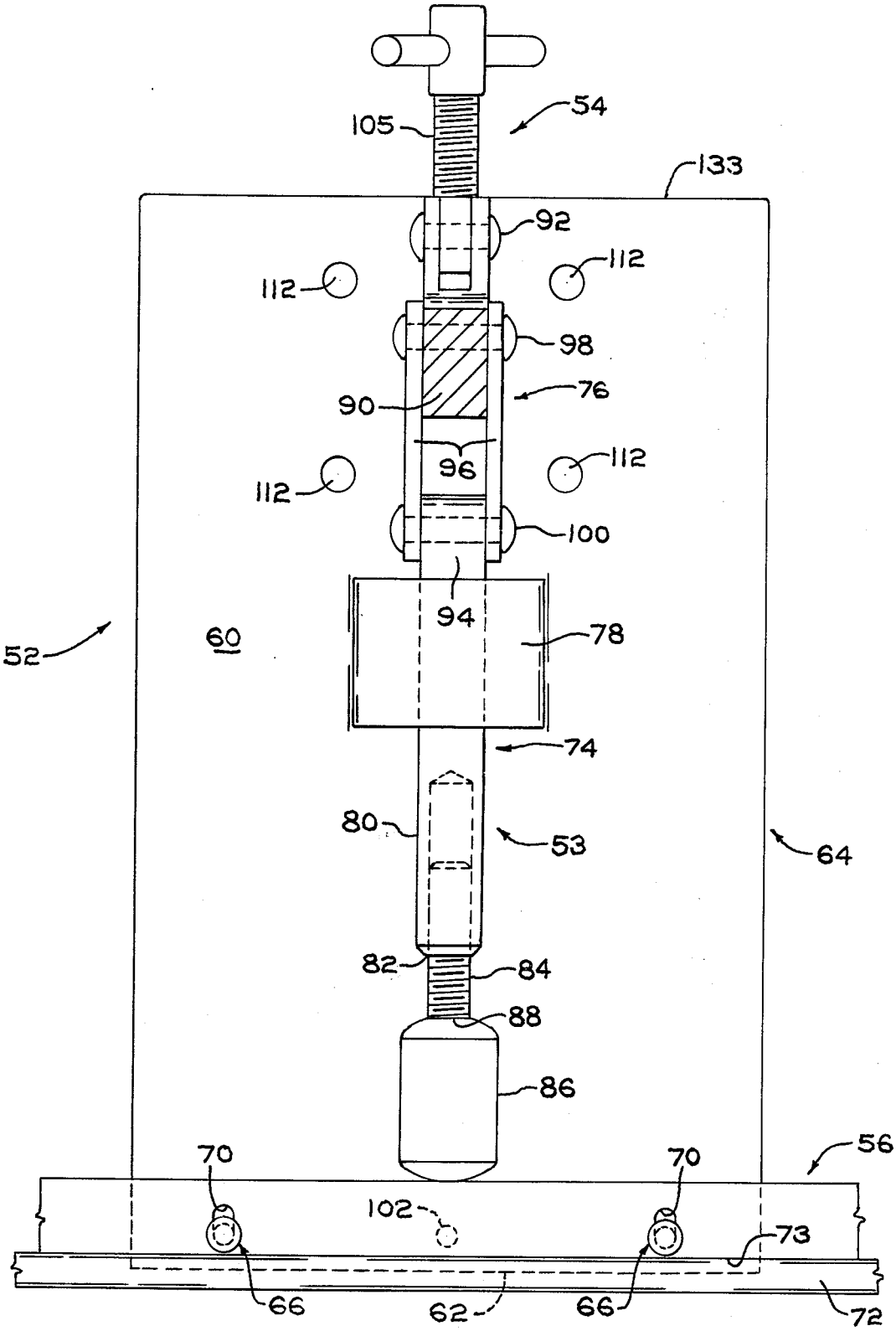
FIG. 4 is a view of the pressure applying facilities of the tool incorporating the features of the invention.

Referring now to FIGS. 3 and 4, there is shown glazing tool 52 incorporating features of the invention for flowing the adhesive 51 to form the insulated, sealed airspace 38.

The tool 52 includes a pressure applying arrangement 53 (shown better in FIG. 4) and a securing arrangement 54 for maintaining the tool 52 in position as pressure is applied to the pane 26 by the pressure applying arrangement 53 to flow the adhesive 51.

The pressure applying arrangement 53 includes a blade 56 slideably mounted in any conventional manner on ledge 58 (shown in FIG. 3) formed on surface 60 adjacent end 62 of plate member 64. For example, a screw and washer arrangement 68 is mounted through each of a pair of spaced elliptical passageways 70 (shown better in FIG. 4) formed in the blade 56 and secured to the ledge 58 of the plate member 64. A resilient pad 72 is preferably mounted on edge 73 of the blade 56 to dampen pressure forces and prevent damage to the pane when the blade 56 is urged against the pane 26 by plunger 74 and straight line action toggle clamp 76 to flow the adhesive 51.

The plunger 74 is slideably mounted in collar 78 mounted on the surface 60 of the plate member 64. The plunger 74 includes a shaft 80 having an internally threaded end 82 receiving threaded shaft 84 for adjusting pressure applied to the blade 56. Increasing the length of the threaded shaft 84 increases the pressure applied to the blade 56 for a given plunger displacement and vice versa.

A compressible member 86, e.g., a spring or rubber member, is mounted on end 88 of the threaded shaft 84 in any conventional manner. The compressible member 86 dampens pressure applied to the blade 56 as the toggle clamp 76 is moved between the engaging position and disengaging position.

Another advantage of the compressible member 86 is to provide visual inspection to determine if sufficient pressure is applied to the blade 56. For example, in the instance where the compressible member 86 is rubber, for a given durometer reading and thickness, a given pressure compresses the member 86 a given amount. As can now be appreciated, the compressible member 86 may be a spring having pressure indices.

The toggle clamp 76 may be any of the type used in the art and includes a lever 90 pivotally mounted at 92 to the surface 60 of the plate member 64 in any conventional manner and connected to end 94 of the shaft 80 by linkage 96. The linkage 96 is pivotally mounted at 98 to the lever 90 and pivotally mounted at 100 to the shaft end 94.

As shown in FIG. 3, moving the lever 90 to the right, i.e., the disengaging position, displaces the plunger 74 upwardly to disengage the blade 56. Moving the lever 90 to the left, i.e., the engaging position, displaces the plunger downwardly as viewed in FIG. 3 to urge or bias the blade 56 against outer marginal edges of the pane 26 to flow the adhesive 51.

With continued reference to FIG. 3, the securing arrangement 54 includes a pin 102 mounted on surface 104 adjacent end 62 of the plate member 64 and a pressure screw 105. The pin 102 is mounted in hole 106 drilled in inner side surface 108 of the frame 24 shown in FIG. 1.

The pressure screw 105 is threaded in internally threaded collar 110 mounted on the plate member surface 104 in any conventional manner, e.g., by screws 112. The pressure screw 105 is provided at end 114 with a platform 116. The platform 116 is preferably joined to the end 114 of the pressure screw 105 by a ball and socket joint 118.

After the pin 102 of the securing arrangement 54 is mounted in the hole 106 of the frame 24, the pressure screw 105 is rotated to move the platform 116 against outer surface 120 of the frame 24 (see FIGS. 1–3). The pressure screw 105 and pin 102 secure the tool 52 on the frame 24.

It has been found that pressure screw 105 is not needed when the depth as measured between the glass sheet 32 of the pane 26 and the outer surface 120 of the frame 24 is sufficient to prevent the tool from pivoting about the frame 24. In other words, the depth is sufficient such that moving the lever 90 of the pressure applying arrangement to the engaging position does not pivot the tool about the frame 24.

In the instance where a ceiling, partition wall or column prevents the use of the pressure applying arrangement as shown in FIG. 3, tool 122 shown in FIG. 5 may be used. The tool 122 includes a first plate 124 joined to a second plate 126. Ledge 128 formed on surface 129 of the plate 126 supports the blade 56 as was discussed for the tool 52 shown in FIG. 3. Mounted on back surface 130 of the plate 126 is the pin 102 (not shown in FIG. 5) of the tool 52 shown in FIG. 3.

A threaded screw 131 passes through the plate 124 and engages the blade 56 to urge the same against the marginal edge of the pane 26 as was discussed for the pressure applying arrangement 53 of the tool 52 shown in FIGS. 3 and 4.

Although not shown in FIG. 5, the tool 122 may have a resilient member mounted on the end of the screw 131 similar to the resilient member 86 shown in FIG. 3. Further, a scaled-down version of the securing arrangement 54 shown in FIG. 3 may be provided on the back surface 130 of the plate 126.

As can now be appreciated, the glass sheets 32 and 22 of the pane 26 and glazing installation 20 respectively may be coated to reduce passage of solar energy and/or infrared energy. Further the pane 26 may include a plurality of glass sheets. Still further, other sheet material, e.g., metal, plastic or wood may be used in the practice of the invention.

DETAILED DESCRIPTION OF THE INVENTION

The glazing tool of the instant invention is used to install a pane 26 (see FIGS. 2 and 3) to an existing glazing 20 (see FIG. 1) to provide an insulated, sealed airspace 38 therebetween.

With reference to FIG. 1, existing glazing installation 20 includes a glass sheet 22 mounted in a frame 24 in any conventional manner. The frame 24 is mounted in a wall structure (not shown) in any conventional manner and has outer perimeter dimensions of about 62 inches (1.55 meters) by 62 inches (1.55 meters); inner perimeter dimensions of about 60 inches (1.5 meters) by 60 inches (1.5 meters). The distance between frame surface 120 and the glass sheet 22 is about 2 inches (5.08 centimeters).

With reference to FIG. 3, the pane 26 includes a square glass sheet 32 about 3/16 inch (0.48 centimeter) thick and side lengths of about 59¼ inches (1.48 meters). A square spacer frame 28 having outer dimensional lengths of about 59¼ inches (1.48 meters), a thickness of about ½ inch (1.27 centimeter) and a width of about ½ inch (1.27 centimeter) is mounted on inner marginal edges 30 of the glass sheet 32 by a layer 34 of a moisture-resistant adhesive of the type taught in U.S. Pat. No. 3,971,178.

The spacer frame 28 is made of welded sections of lock seam spacer having desiccant material 36 therein and is of the type taught in U.S. Pat. No. 2,684,266. A composite strip 40 having an aluminum tape 44 about 0.008 inch (2.0 centimeters) thick and adhesive 42 is adhered to the outer marginal edges 46 and peripheral edges 48 of the glass sheet 32 and peripheral edges 50 of the spacer frame 28 by a layer 42 of moisture-impervious adhesive. The construction of the pane 26 is similar to the pane shown in FIG. 15 of U.S. Pat. No. 3,971,178.

With reference to FIGS. 3 and 4, tool 52 incorporating features of the invention includes a plate member 64 having a length of about 8 inches (20.32 centimeters) and a width of about 2 inches (5.08 centimeters), and a thickness of about 3/16 inch (0.48 centimeter). A metal plunger 80 having a length of about 3⅝ inch (9.2 centimeters) and an outside diameter of about ½ inch (1.27 centimeter) is slideably mounted in collar 78 mounted on surface 60 of the plate member 64. A lever 90 is pivoted at 92 to the plate member adjacent end 133 and operatively connected to the plunger 80 by linkage 96 pivotally mounted at 98 to the lever 90 and at 100 to end 94 of the plunger 80. The linkage 96 is sized and the pivot points positioned such that the plunger 80 is displaced a distance of about 1¼ inch (3.2 centimeters) when the lever 90 is moved from the engaging or disengaging position to the disengaging or engaging position respectively.

A threaded metal shaft 84 having a length of about 3 inches (7.62 centimeters) is threaded into end 82 of the plunger 80. A rubber member 86 having a diameter of about ½ inch (1.27 centimeter), a length of about ¾ inch (1.9 centimeter) and a durometer reading of about 50 is mounted to the end 88 of the threaded shaft 84 in any conventional manner.

A metal blade 56 having a length of about 18 inches (0.45 meter), a width of about ¾ inch (1.9 centimeter) and a height of about ⅜ inch (0.98 centimeter) is mounted on ledge 58 formed on surface 60 of the plate member 64 adjacent end 62. The ledge 58 has a length of about 2 inches (5.08 centimeters), a height of about ½ inch (1.27 centimeter) and a width of about ½ inch (1.27 centimeter). The blade 56 is slideably mounted to the ledge 58 by a pair of screw and washer arrangements 66 passing through elliptical passageways 70 formed in the blade 56 and secured to the ledge 58. The screws and passageways 60 are sized to allow about ⅝ inch (1.6 centimeter) sliding displacement of the blade 56.

A rubber member 72 about 18 inches (0.45 meter) in length, ⅜ inch (0.98 centimeter) wide, ⅛ inch (0.32 centimeter) thick and having a durometer reading of about 60 is mounted on surface 73 of the blade 56.

An internally threaded collar 110 is mounted on surface 104 of the plate member 64 to receive threaded shaft 105. The threaded shaft 105 has a length of about 8 inches (20 centimeters) and a diameter of about ½ inch (1.27 centimeter). A platform having a diameter of about 1¼ inch (3.20 centimeters) is advantageously mounted to end 114 of the threaded shaft 105 by a ball and socket joint 118.

A steel pin having a diameter of about ⅛ inch (0.32 centimeter) and a length of about ¼ inch (0.64 centimeter) is centrally located adjacent the end 62 on the surface 104 of the plate member 64.

With reference to FIG. 1, a plurality of holes 106 having a diameter of about 9/64 inch (0.35 centimeter) are drilled in surface 108 of the frame 24. Three holes 106 are drilled on each side of the frame on center-to-center spacing of about 20 inches (0.5 meter) from each other and about 10 inches (0.25 meter) from the adjacent side of the frame 24. The holes 106 are spaced about 1 inch (2.54 centimeters) from the glass sheet 22 mounted in the frame 24.

With reference to FIG. 3, a layer 51 of a room temperature flowable moisture-resistant adhesive of the type taught in U.S. Pat. No. 3,971,178 is provided on outer surface of the spacer frame 28. The layer 51 of adhesive has a thickness of about ⅛ inch (0.32 centimeter).

Referring now to FIG. 2, a pair of neoprene spacer blocks 135 having a height of about ⅜ inch (0.95 centimeter), a width of about 4 inches (10.16 centimeters) and a thickness of about 11/16 inch (1.75 centimeter) are positioned on surface 106 of the frame as shown in FIG. 2. The pane 26 rests on the blocks and is urged against the glass sheet 22 in the frame 24.

A glazing tool 52 is mounted in each hole 106 in the frame 24 by inserting the pin 102 of the tool 52 in the hole 106. The pressure screw 105 is threaded to urge the platform 116 against surface 120 of the frame 24 to secure the tool 52 to the frame 24. The threaded screw 84 is adjusted to extend about 1¼ inch (3.18 centimeters) out of the plunger end 82. The lever 90 of each tool is moved to the engaging position to bias the blade 56 against the marginal edges of the pane 24. The biasing action of the blade 56 flows the adhesive layer 51 between the spacer frame 28 and glass sheet 22 of the existing glazing installation 20 to form an insulated sealed airspace 38 between the glass sheets 22 and 32.

The tools 52 are left in position for a period of about 3 minutes and thereafter removed.

The space between the panel 26 and frame 24 of the window 20 is dressed as taught in U.S. Pat. No. 3,971,178.

As can be appreciated, the above example is merely presented to illustrate one embodiment of the invention and the invention is not limited thereto.

What is claimed is:

1. A tool for installing an add-on pane to an existing glazing, comprising:

a plate member having a first surface and a second opposite surface;

a pin mounted on the second surface of the plate;

a threaded shaft mounted on the second surface of said plate member;

a platform pivotally mounted to an end of said threaded shaft;

said pin, said threaded shaft and said platform coact to mount said plate member to frame of the existing glazing;

a plunger slideably mounted on the first surface of said plate member;

force dampening means mounted on an end of said plunger;

a rigid elongated member slideably mounted on the first surface of said plate member adjacent a side of said plate member; and lever means acting on said plunger for urging said plunger toward said elongated member to move said force dampening means into engagement with said rigid elongated member.

2. The tool as set forth in claim 1 further including:

a resilient member mounted on a surface of said rigid elongated member opposite to the surface biased by said plunger means.

3. The tool as set forth in claim 1 further including:

pressure indicating means mounted on said plunger.

* * * * *